US011826600B2

(12) United States Patent
Park et al.

(10) Patent No.: US 11,826,600 B2
(45) Date of Patent: Nov. 28, 2023

(54) EXERCISE WEIGHT BAG

(71) Applicant: 5.11, Inc., Manteca, CA (US)

(72) Inventors: Sharon Jieun Park, Irvine, CA (US); Justin Chambers, Costa Mesa, CA (US); Alan Anthony Vespe, Long Beach, CA (US); Joel Soriano Alarcon, Irvine, CA (US)

(73) Assignee: 5.11, Inc., Manteca, CA (US)

( * ) Notice: Subject to any disclaimer, the term of this patent is extended or adjusted under 35 U.S.C. 154(b) by 17 days.

(21) Appl. No.: 17/566,468

(22) Filed: Dec. 30, 2021

(65) Prior Publication Data

US 2022/0331640 A1 Oct. 20, 2022

Related U.S. Application Data

(60) Provisional application No. 63/175,462, filed on Apr. 15, 2021.

(51) Int. Cl.

| | |
|---|---|
| ***A63B 21/065*** | (2006.01) |
| ***A63B 21/06*** | (2006.01) |
| ***A63B 21/00*** | (2006.01) |

(52) U.S. Cl.

CPC ..... *A63B 21/065* (2013.01); *A63B 21/00065* (2013.01); *A63B 21/0603* (2013.01); *A63B 21/4001* (2015.10); *A63B 21/4025* (2015.10)

(58) Field of Classification Search

CPC ..... A63B 21/0603; A63B 21/065; A63B 21/00058; A63B 21/00061; A63B 21/00065; A63B 21/00178; A63B 21/06; A63B 21/0601; A63B 21/0602; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025; A63B 6/00

See application file for complete search history.

(56) References Cited

U.S. PATENT DOCUMENTS

| | | | |
|---|---|---|---|
| 4,658,442 | A | 4/1987 | Tomlinson et al. |
| 5,659,898 | A | 8/1997 | Bell, Jr. |
| 5,978,964 | A | 11/1999 | Gaston |

(Continued)

OTHER PUBLICATIONS

Sand Filler Bags, https://ultimatesandbagtraining.com/product/sand-filler-bags/, retrieved on Mar. 25, 2022.

(Continued)

*Primary Examiner* — Megan Anderson

(74) *Attorney, Agent, or Firm* — Knobbe Martens Olson & Bear LLP

(57) ABSTRACT

An exercise weight bag is configured to be filled with a weight material, such as a granular material. In some configurations, the weight bag is sized and shaped to be received in a receptacle of a tactical-style vest. The weight bag can include a baffle that limits separation of a front panel and a rear panel. The weight bag can include one or more reinforcement panels that are more rigid than the front and rear panels to provide shape to the weight bag. The weight bag can include top and/or side adjustment features to allow for adjustment of a height and/or width of the weight bag.

13 Claims, 5 Drawing Sheets

(56) References Cited

U.S. PATENT DOCUMENTS

| | | | | |
|---|---|---|---|---|
| 6,099,441 | A * | 8/2000 | Bonnet | A63B 21/0602 482/106 |
| 6,149,555 | A * | 11/2000 | Kinback | A63B 21/0603 482/93 |
| 8,276,351 | B1 | 10/2012 | Henkin | |
| 8,343,019 | B2 * | 1/2013 | Friend | A63B 21/065 482/7 |
| 10,252,097 | B1 * | 4/2019 | Raines | E02B 3/127 |
| 10,933,271 | B2 * | 3/2021 | Pace | A63B 21/4043 |
| 2012/0149536 | A1 | 6/2012 | Trimble et al. | |
| 2014/0213421 | A1 * | 7/2014 | Paris | A63B 21/065 482/105 |
| 2014/0309089 | A1 * | 10/2014 | Buikema | A63B 21/0004 482/105 |
| 2016/0367848 | A1 * | 12/2016 | Seuk | A63B 21/00065 |
| 2017/0001060 | A1 * | 1/2017 | D'Alesio | A63B 21/0602 |
| 2019/0184252 | A1 * | 6/2019 | Raines | A63B 41/085 |
| 2020/0154912 | A1 * | 5/2020 | Del Balso | A47G 9/10 |

OTHER PUBLICATIONS

Rogue USA Cast Weight Vest Plates, https://www.roguefitness.com/usa-cast-weight-vest-plate, retrieved on Mar. 25, 2022.

* cited by examiner

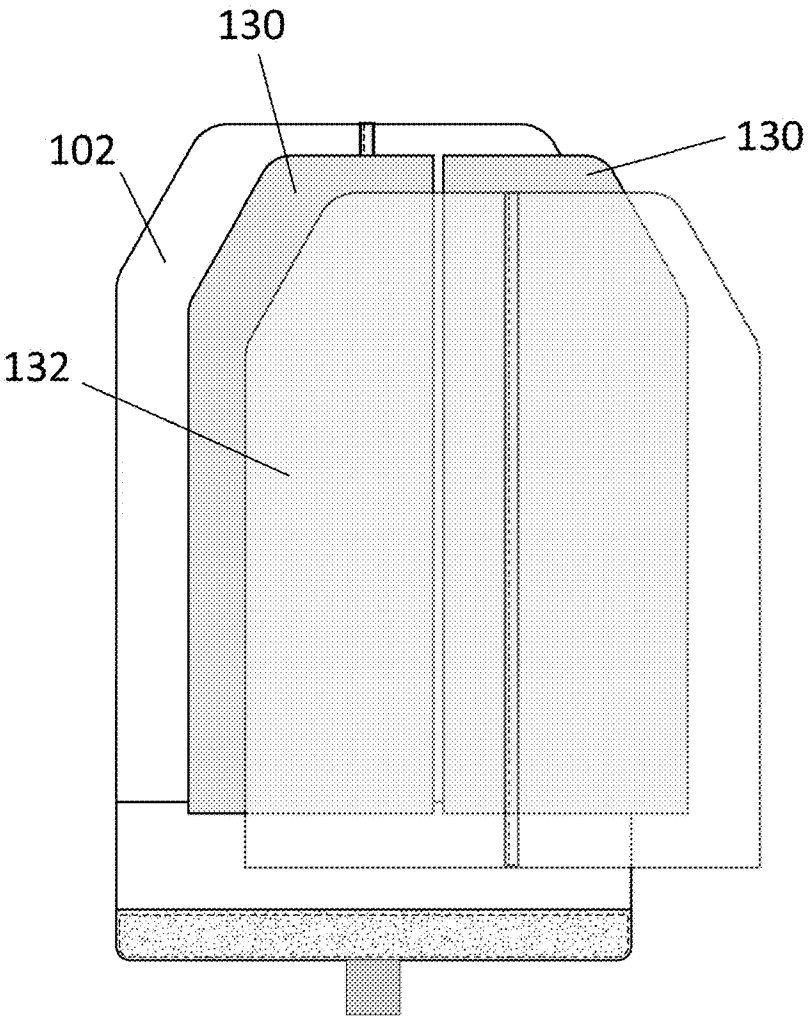
Fig. 14
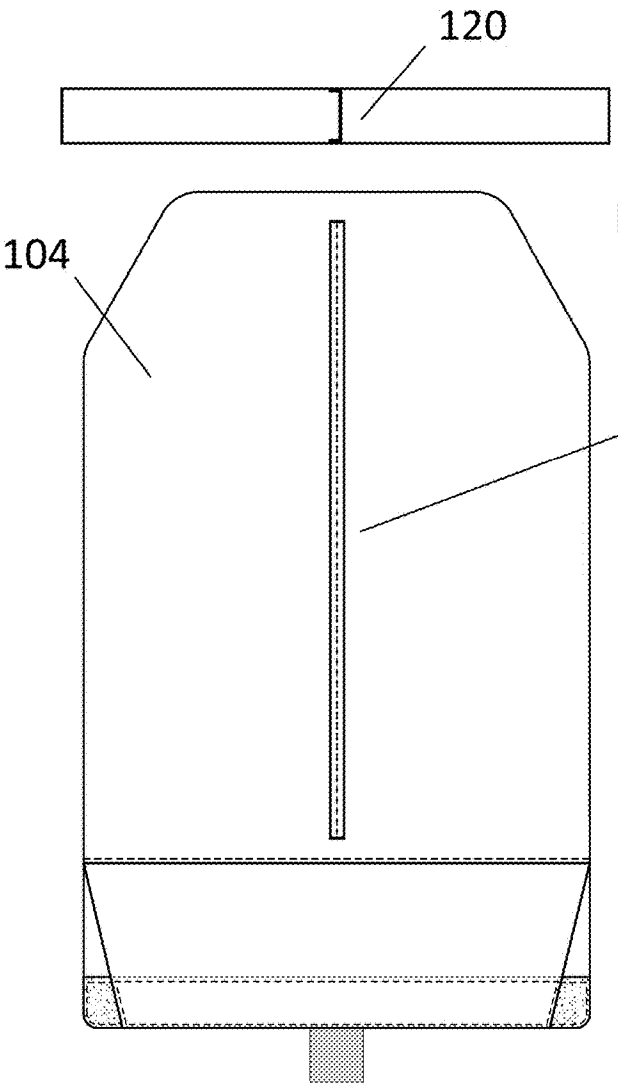
Fig. 13
Fig. 12

EXERCISE WEIGHT BAG

RELATED APPLICATION

This application is related to, and claims priority from, U.S. Provisional Patent Application No. 63/175,462, filed Apr. 15, 2021, the entirety of which is hereby incorporated by reference herein and made a part of the present disclosure.

BACKGROUND

Field

The present disclosure relates to exercise equipment. In particular, the present disclosure relates to an exercise weight bag.

Description of Related Art

Exercising with excess weight carried by the user has become popular. In some cases, the excess weight is carried in a vest, such as a tactical-style vest. The weights often used with a tactical-style vest can be flat plates constructed from a dense material, such as metal (e.g., steel or cast iron). In some cases, the plates can be curved with a fixed curvature.

SUMMARY

Existing rigid vest plates have several disadvantages. For example, depending on the size of the user, the plates may not wrap closely around the user's torso and, due to the rigidity of the plates, will not move with the user during exercise. In addition, shipping the plates is expensive. Some embodiments address one or both of these issues with the prior art vest plates.

The systems, methods and devices described herein have innovative aspects, no single one of which is indispensable or solely responsible for their desirable attributes. Without limiting the scope of the claims, some of the advantageous features will now be summarized.

An aspect of the present disclosure involves an exercise weight bag having a flexible front panel and a flexible rear panel. The exercise weight bag defines a closable interior space between the front panel and the rear panel configured to receive a weight material. A baffle is located within the interior space. The baffle extends between and connects the front panel and the rear panel to limit separation of the front panel and the rear panel.

In some configurations, the baffle extends between a bottom end and a top end of the exercise weight bag.

In some configurations, the baffle is located on a centerline of the exercise weight bag.

In some configurations, the exercise weight bag includes at least one reinforcement panel positioned within the interior space. The at least one reinforcement panel is more rigid than the front panel and the rear panel to provide shape to the exercise weight bag.

In some configurations, the at least one reinforcement panel comprises a front reinforcement panel and a rear reinforcement panel.

In some configurations, the at least one reinforcement panel comprises a first side reinforcement panel and a second side reinforcement panel located adjacent one of the front panel and the rear panel. The exercise weight bag is able to bend along a line or region defined between the first side reinforcement panel and the second side reinforcement panel.

In some configurations, the at least one reinforcement panel further comprises a third side reinforcement panel and a fourth side reinforcement panel located adjacent the other of the front panel and the rear panel. The exercise weight bag is able to bend along a line or region defined between the third side reinforcement panel and the fourth side reinforcement panel.

In some configurations, the exercise weight bag includes one or more of a top adjustment flap, a first side adjustment flap, and a second side adjustment flap, each having a first side connected to one of the front panel and the rear panel and a second side configured to be releasably and adjustably connected to the other of the front panel and the rear panel to allow for adjustment of a height or width of the exercise weight bag.

In some configurations, each of the top adjustment flap, the first side adjustment flap, and the second side adjustment flap comprises a grip tab.

In some configurations, the exercise weight bag includes a bottom closure arrangement comprising one or both of a seal and a closure flap.

In some configurations, the closure flap comprises a grip tab.

An aspect of the present disclosure involves an exercise weight bag having a flexible front panel and a flexible rear panel. The exercise weight bag defines a closable interior space between the front panel and the rear panel configured to receive a weight material. At least one reinforcement panel is positioned within the interior space. The at least one reinforcement panel is more rigid than the front panel and the rear panel to provide shape to the exercise weight bag.

In some configurations, the at least one reinforcement panel comprises a front reinforcement panel and a rear reinforcement panel.

In some configurations, the at least one reinforcement panel comprises a first side reinforcement panel and a second side reinforcement panel located adjacent one of the front panel and the rear panel. The exercise weight bag is able to bend along a line or region defined between the first side reinforcement panel and the second side reinforcement panel.

In some configurations, the at least one reinforcement panel further comprises a third side reinforcement panel and a fourth side reinforcement panel located adjacent the other of the front panel and the rear panel. The exercise weight bag is able to bend along a line or region defined between the third side reinforcement panel and the fourth side reinforcement panel.

In some configurations, the exercise weight bag includes one or more of a top adjustment flap, a first side adjustment flap, and a second side adjustment flap, each having a first side connected to one of the front panel and the rear panel and a second side configured to be releasably and adjustably connected to the other of the front panel and the rear panel to allow for adjustment of a height or width of the exercise weight bag.

In some configurations, each of the top adjustment flap, the first side adjustment flap, and the second side adjustment flap comprises a grip tab.

In some configurations, the exercise weight bag includes a bottom closure arrangement comprising one or both of a seal and a closure flap.

In some configurations, the closure flap comprises a grip tab.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

FIG. 12 is a rear view of the exercise weight bag of FIG. 1 showing a baffle that limits separation of a front panel and a rear panel of the exercise weight bag.

FIG. 13 is a sectional view of the exercise weight bag of FIG. 12.

FIG. 14 is an exploded view of the exercise weight bag of FIG. 12 illustrating a pair of reinforcement panels.

DETAILED DESCRIPTION

Figure 2:
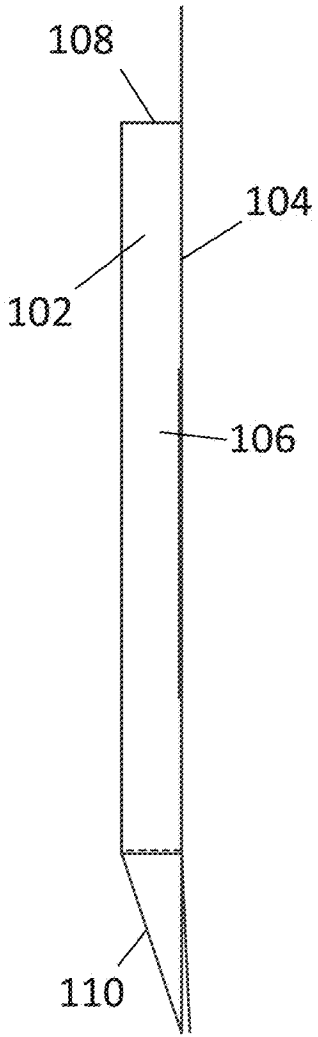
FIG. 2 is a side view of the exercise weight bag of FIG. 1.
Figure 1:
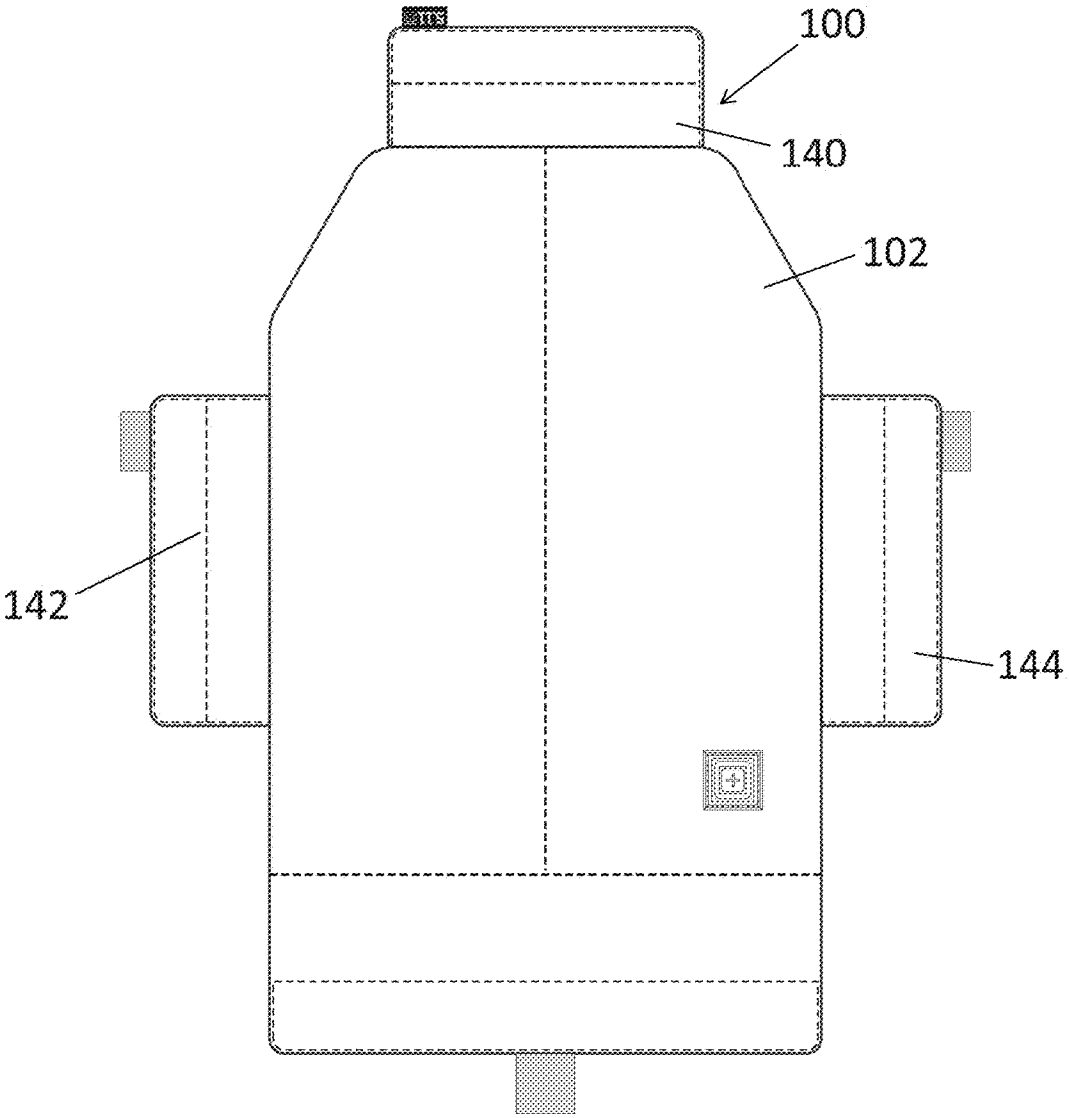
FIG. 1 is a front view of an exercise weight bag having certain features, aspects and advantages of a preferred embodiment in an open orientation.
Figure 4:
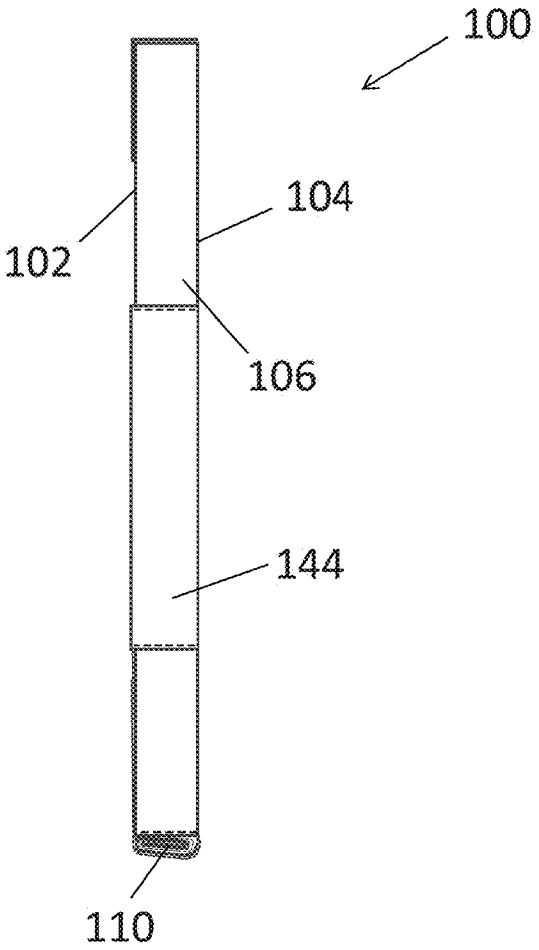
FIG. 4 is a side view of the exercise weight bag of FIG. 3.
Figure 3:
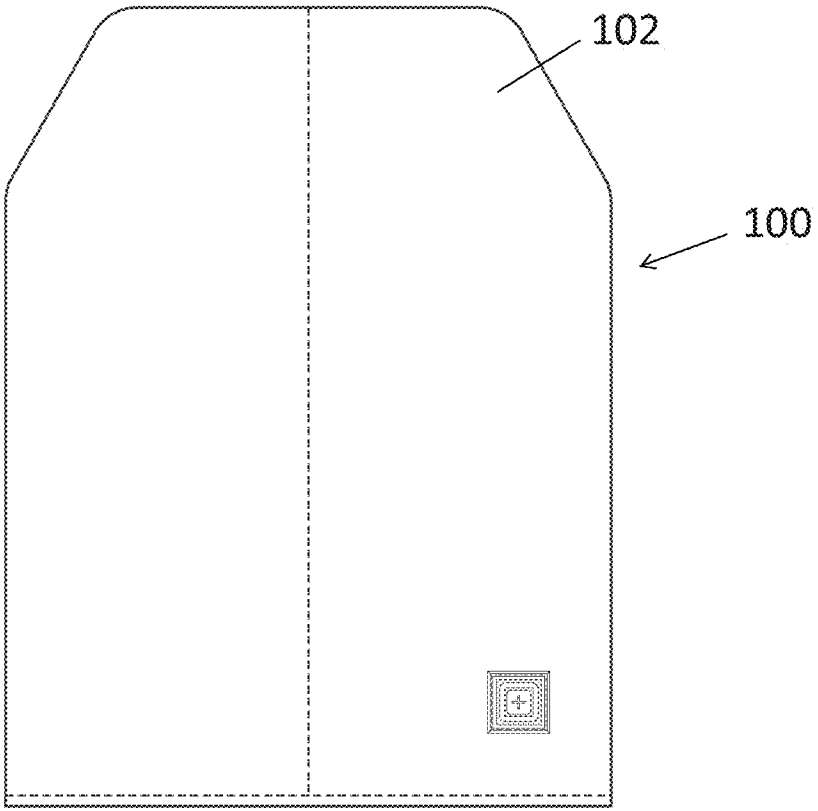
FIG. 3 is a front view of the exercise weight bag of FIG. 1 in a closed orientation.

Embodiments of systems, components and methods of assembly and manufacture will now be described with reference to the accompanying Figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1-14 illustrate an embodiment of an exercise weight bag 100, which is configured to be filled with a weight material, such as a granular material (e.g., sand, gravel, pebbles, rice, animal feed, rubber mulch, metal pellets, wood pellets). Accordingly, the exercise weight bag 100 can be shipped empty and filled with a desired material to a desired weight by the end user. Such an arrangement reduces shipping costs and increases convenience.

The illustrated exercise weight bag 100 is in the form of a weighted insert that is configured to be received in a pocket or other receptacle of a vest, such as a tactical-style vest. An example of such a vest is the TacTec® Plate Carrier sold by 5.11, Inc., the Applicant of the present application. Accordingly, the exercise weight bag 100 preferably has the general size and shape of a ballistic plate for a vest or an exercise-oriented vest plate, such as the Vest Plates sold by Rogue Fitness (Columbus, Ohio). In some configurations, the exercise weight bag 100 has a length of about 9-14 or 10-12 inches (e.g., 11.25 inches) and a width of about 6-12 or 8-10 inches (e.g., 9.25 inches). In some configurations, the thickness of the exercise weight bag 100 is about 0.5-2 inches, or more.

The exercise weight bag 100 can include multiple portions or panels secured together to define a fillable interior space. The portions or panels can be constructed in whole or in part from a sturdy fabric material, such as a nylon fabric, for example. The portions or panels can be secured together by any suitable arrangement or method, such as a sewn seam.

The illustrated exercise weight bag 100 includes at least a flexible front panel 102 and a flexible rear panel 104. The exercise weight bag 100 defines a closable interior space between the front panel 102 and the rear panel 104. The front panel 102 and the rear panel 104 can be coupled to one another along one or more edges. In the illustrated arrangement, the front panel 102 and the rear panel 104 are connected by side panels 106 and a top panel 108. However, in other arrangements, the front panel 102 and the rear panel 104 could be directly connected to one another.

In the illustrated arrangement, the exercise weight bag 100 is configured to be filled from the bottom end. The bottom end includes a filler funnel arrangement 110 in the form of triangular shaped sidewall when viewed from the side such that portions of the front panel 102 and rear panel 104 come together at the terminal portion of the bottom end. The filler funnel arrangement 110 includes an open end defined by terminal ends of the front panel 102 and the rear panel 104 through which weight material or filler material can be introduced into the interior space of the exercise weight bag 100.

Figures 5, 6, 7, 8, 9:
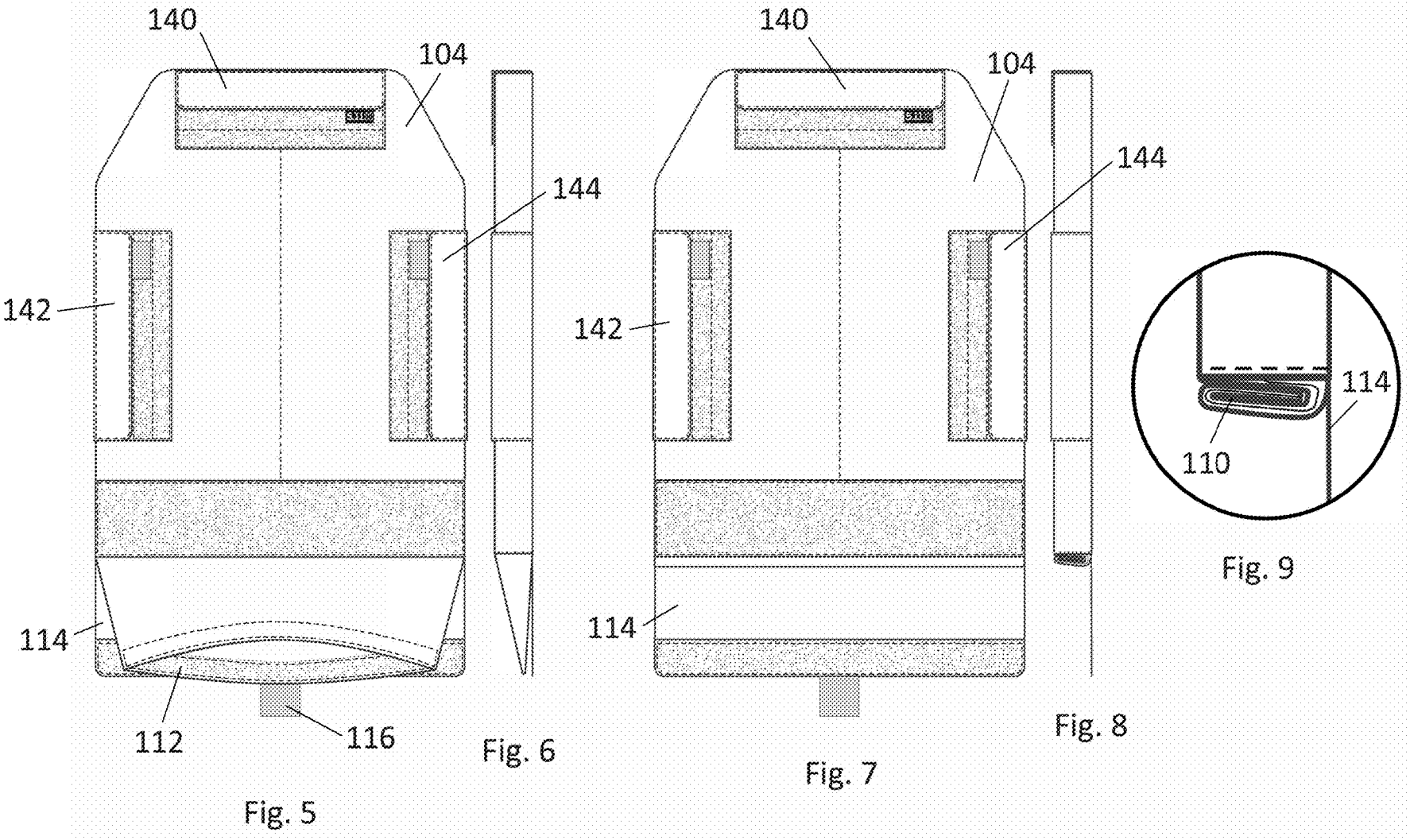
FIG. 5 is a rear view of the exercise weight bag of FIG. 1 with a bottom end open to allow for filling of the bag.
FIG. 6 is a side view of the exercise weight bag of FIG. 5.
FIG. 7 is a rear view of the exercise weight bag of FIG. 1 with a filler portion closed and a bottom flap open.
FIG. 8 is a side view of the exercise weight bag of FIG. 7.
FIG. 9 is an enlarged view of the bottom of the filler portion of FIGS. 7 and 8.
Figure 11:
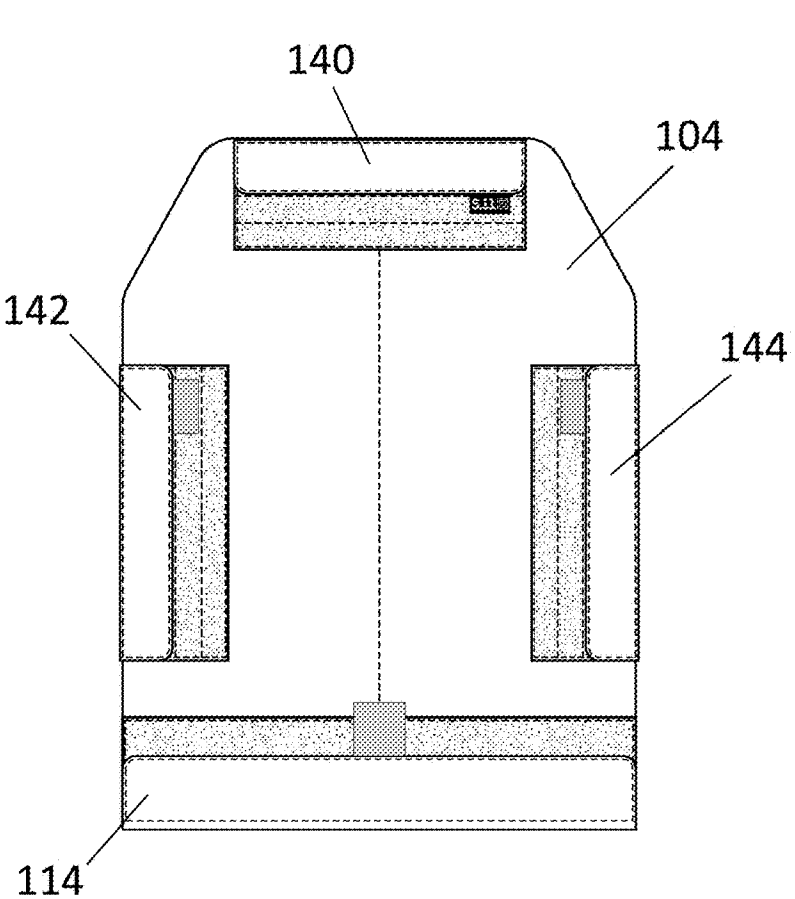
FIG. 11 is a rear view of the exercise weight bag of FIG. 10 with the adjustment flaps shown closed.
Figure 10:
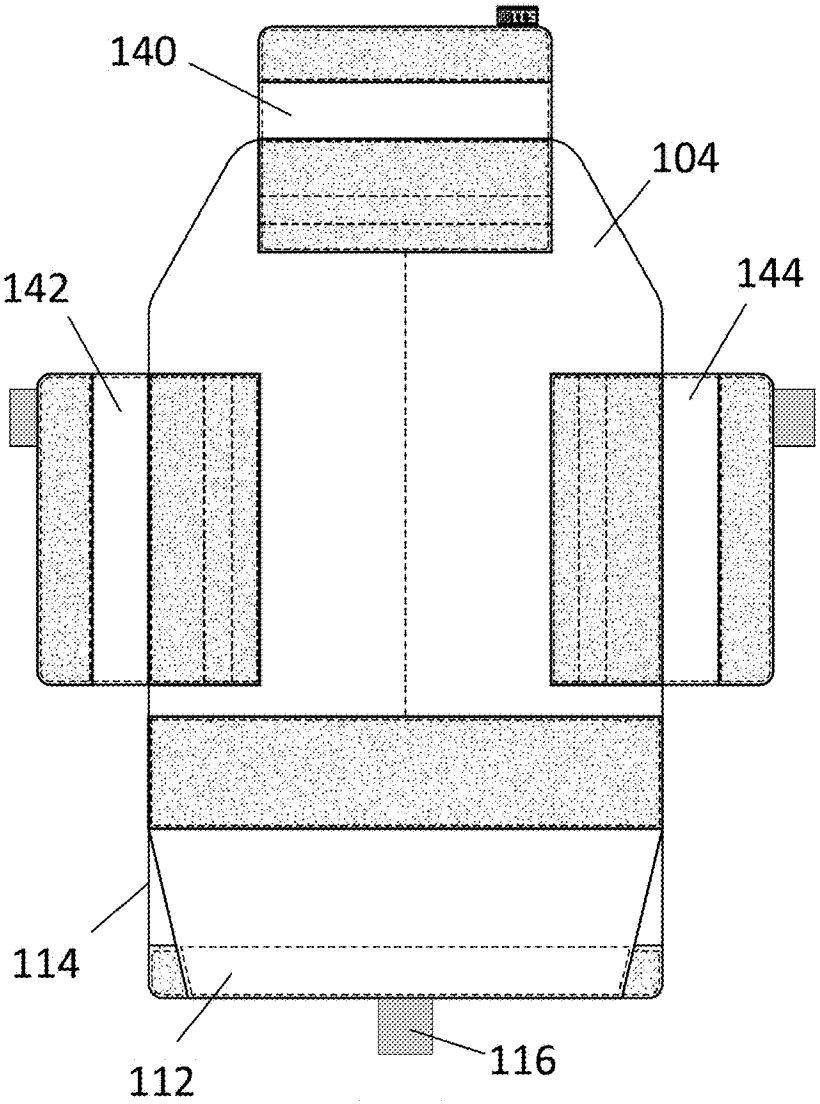
FIG. 10 is a rear view of the exercise weight bag of FIG. 1 with adjustment flaps shown open.

The filler funnel arrangement 110 can include a seal closure 112 that releasably couples the front panel 102 and the rear panel 104. For example, interior portions of the front panel 102 and the rear panel 104 can include cooperating portions of a hook-and-loop fastener (FIG. 5). In some configurations, the exercise weight bag 100 also includes a closure flap 114. In use, the seal closure 112 can close the filler funnel arrangement 110, which can be rolled up as illustrated in FIGS. 8 and 9. The closure flap 114 can be folded over the rolled-up filler funnel arrangement 110 and secured to the body of the exercise weight bag 100, such as by a hook-and-loop fastener. In the illustrated arrangement, the closure flap 114 releasably couples to the rear panel 104. In some configurations, the closure flap 114 comprises a grip tab 116 to facilitate opening of the closure flap 114.

In some configurations, the exercise weight bag 100 includes a connection between the front panel 102 and the rear panel 104 to restrict or limit separation of the panels 102, 104. The connection can be in the form of a tether or restraint. The connection can further be in the form of a cable system, a bungee system, a cord system, or any other suitable connection type. In the illustrated arrangement, the connection is provided by a baffle 120 located within the interior space of the exercise weight bag 100. The baffle 120 extends between and connects the front panel 102 and the rear panel 103. The illustrated baffle 120 is formed by a length of material coupled (e.g., sewn) to the front panel 102 and the rear panel 104. In the illustrated arrangement, the baffle 120 extends in a direction between a bottom end and a top end of the exercise weight bag 100. In the illustrated arrangement, the baffle 120 is vertically oriented and is located on a centerline of the exercise weight bag 100 to bisect the interior space into two equal sides or halves. However, in other arrangements, the baffle 120 could be horizontal, diagonal or oblique.

Although only a single baffle 120 is illustrated, multiple baffles 120 could be provided if desired. In addition, although the illustrated baffle 120 has a fixed width (the thickness direction of the exercise weight bag 100), the baffle 120, or any other form of connection between the front panel 102 and the rear panel 104, could be adjustable if desired to allow for adjustment of the separation distance between the front panel 102 and the rear panel 104 (the thickness of the exercise weight bag 100).

In some configurations, the exercise weight bag 100 includes at least one reinforcement panel 130 (FIG. 14) positioned within the interior space. The reinforcement panel 130 is more rigid than the front panel 102 and the rear panel 104 to provide shape to the exercise weight bag 100. The reinforcement panel 130 can be constructed in whole or in part from any suitably rigid material, such as polyethylene. The reinforcement panel 130 can be coupled to the respective one of the front panel 102 and the rear panel 104. For example, the reinforcement panel 130 could be sewn to the panel 102, 104. Or, an additional layer of material 132 could be provided to create a pocket with the panel 102, 104 within which the reinforcement panel 130 can be secured. Or, the reinforcement panel 130 can be secured using a hook and loop connection. Less desirably, the reinforcement panel (s) 130 could be loosely provided within the interior space of the exercise weight bag 100.

In some configurations, a front reinforcement panel 130 and a rear reinforcement panel 130 are provided adjacent or coupled to the front panel 102 and the rear panel 104, respectively. In some configurations, a pair of front reinforcement panels 130 and/or a pair of rear reinforcement panels 130 are provided. The pairs of panels 130 can be provided on either side of the baffle 120. With such an arrangement, some relative movement of the front reinforcement panels 130 and/or rear reinforcement panels 130 is permitted to allow the exercise weight bag 100 to better conform to the user's torso. That is, the exercise weight bag 100 is able to bend along a line or region defined between the first side reinforcement panel 130 and the second side reinforcement panel 130 in either or both of the front and rear of the exercise weight bag 100.

In some configurations a front panel 102 or a rear panel 104 may embody a material and or function similar to that of a reinforcement panel 130. The front panel 102 or a rear panel 104 may comprise multiple reinforcement panels 130 selectively placed in various locations. The reinforcement panels 130 may be strips, squares, or other alternative shapes and may be connected to the front panel 102 or the rear panel 104 through various connections methods discussed above. The reinforcement panels 130 may further vary in stiffness or compliance. The reinforcement panels 130 may be stiffer or more compliant to better accommodate different loads.

In some configurations, the exercise weight bag includes one or more of a top adjustment flap 140, a first side adjustment flap 142, and a second side adjustment flap 144. Each adjustment flap 140, 142, 144 has a first side connected to one of the front panel and the rear panel and a second side configured to be releasably and adjustably connected to the other of the front panel and the rear panel to allow for adjustment of a height or width of the exercise weight bag 100. In the illustrated arrangement, the adjustment flaps 140, 142, 144 are fixedly connected to the front panel 102 and releasably and adjustably connectable to the rear panel 104 by a hook-and-loop fastener arrangement. In some configurations, each of the top adjustment flap 140, the first side adjustment flap 142, and the second side adjustment flap 144 comprises a grip tab 116 to facilitate release of the adjustment flap 140, 142, 144.

In some configurations, each of the top adjustment flap 140, the first side adjustment flap 142, and the second side adjustment flap 144 may be used to more securely hold the load. The top adjustment flap 140, the first side adjustment flap 142, and the second side adjustment flap 144 may be made of an elastic material. The top adjustment flap 140, the first side adjustment flap 142, and the second side adjustment flap 144 may be made of an elastic material, may be a ratcheting mechanism, a belt like strap system, or any other system that may allow the exercise weight bag 100 to adjust its height, adjust its width, or adjust the squeeze force between the front panel 102 and rear panels 104.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. An exercise weight bag, comprising:

a flexible front panel;

a flexible rear panel;

wherein the exercise weight bag defines a closable interior space between the flexible front panel and the flexible rear panel configured to receive a weight material;

a baffle located within the closable interior space and that extends between and connects the flexible front panel and the flexible rear panel to limit separation of the flexible front panel and the flexible rear panel;

wherein the baffle extends in a direction between a bottom end and a top end of the exercise weight bag;

wherein the baffle is located on a centerline of the exercise weight bag;

at least one reinforcement panel positioned within the closable interior space, the at least one reinforcement panel being more rigid than the flexible front panel and the flexible rear panel to provide shape to the exercise weight bag.

2. The exercise weight bag of claim 1, wherein the at least one reinforcement panel comprises a first side reinforcement panel and a second side reinforcement panel located adjacent one of the flexible front panel and the flexible rear panel, wherein the exercise weight bag is able to bend along a line or region defined between the first side reinforcement panel and the second side reinforcement panel.

3. The exercise weight bag of claim 2, wherein the at least one reinforcement panel further comprises a third side reinforcement panel and a fourth side reinforcement panel located adjacent the other of the flexible front panel and the flexible rear panel, wherein the exercise weight bag is able to bend along a line or region defined between the third side reinforcement panel and the fourth side reinforcement panel.

4. The exercise weight bag of claim 1, wherein the at least one reinforcement panel comprises a front reinforcement panel and a rear reinforcement panel.

5. An exercise weight bag, comprising:

a flexible front panel;

a flexible rear panel;

wherein the exercise weight bag defines a closable interior space between the flexible front panel and the flexible rear panel configured to receive a weight material;

a baffle located within the closable interior space and that extends between and connects the flexible front panel and the flexible rear panel to limit separation of the flexible front panel and the flexible rear panel;

one or more of a top adjustment flap, a first side adjustment flap, and a second side adjustment flap, each having a first side connected to one of the flexible front panel and the flexible rear panel and a second side configured to be releasably and adjustably connected to the other of the flexible front panel and the flexible rear panel to allow for adjustment of a height or width of the exercise weight bag.

6. The exercise weight bag of claim 5, wherein each of the top adjustment flap, the first side adjustment flap, and the second side adjustment flap comprises a grip tab.

7. An exercise weight bag, comprising:

a flexible front panel;

a flexible rear panel;

wherein the exercise weight bag defines a closable interior space between the flexible front panel and the flexible rear panel configured to receive a weight material;

at least one reinforcement panel positioned within the closable interior space, the at least one reinforcement panel being more rigid than the flexible front panel and the flexible rear panel to provide shape to the exercise weight bag;

one or more of a top adjustment flap, a first side adjustment flap, and a second side adjustment flap, each having a first side connected to one of the flexible front panel and the flexible rear panel and a second side configured to be releasably and adjustably connected to the other of the flexible front panel and the flexible rear panel to allow for adjustment of a height or width of the exercise weight bag.

8. The exercise weight bag of claim 7, wherein the at least one reinforcement panel comprises a first side reinforcement panel and a second side reinforcement panel located adjacent one of the flexible front panel and the flexible rear panel, wherein the exercise weight bag is able to bend along a line or region defined between the first side reinforcement panel and the second side reinforcement panel.

9. The exercise weight bag of claim 8, wherein the at least one reinforcement panel further comprises a third side reinforcement panel and a fourth side reinforcement panel located adjacent the other of the flexible front panel and the flexible rear panel, wherein the exercise weight bag is able to bend along a line or region defined between the third side reinforcement panel and the fourth side reinforcement panel.

10. The exercise weight bag of claim 7, further comprising a bottom closure arrangement comprising one or both of a seal and a closure flap.

11. The exercise weight bag of claim 10, wherein the closure flap comprises a grip tab.

12. The exercise weight bag of claim 7, wherein the at least one reinforcement panel comprises a front reinforcement panel and a rear reinforcement panel.

13. The exercise weight bag of claim 12, wherein each of the top adjustment flap, the first side adjustment flap, and the second side adjustment flap comprises a grip tab.

* * * * *